US008827190B2

(12) United States Patent
Redman

(10) Patent No.: US 8,827,190 B2
(45) Date of Patent: Sep. 9, 2014

(54) ROCK DUSTING APPARATUS

(76) Inventor: Larry Redman, Fraziers Bottom, WV (US)

( * ) Notice: Subject to any disclaimer, the term of this patent is extended or adjusted under 35 U.S.C. 154(b) by 828 days.

(21) Appl. No.: 12/779,643

(22) Filed: May 13, 2010

(65) Prior Publication Data

US 2010/0288858 A1 Nov. 18, 2010

Related U.S. Application Data

(60) Provisional application No. 61/178,651, filed on May 15, 2009.

(51) Int. Cl.
*A01C 3/06* (2006.01)
*E21F 5/10* (2006.01)

(52) U.S. Cl.
CPC ..... *E21F 5/10* (2013.01)
USPC ..... 239/654; 239/85; 239/143; 239/650; 406/92; 406/146; 222/195

(58) Field of Classification Search
USPC ..... 239/85, 143, 650, 654; 406/90, 92, 146; 222/195, 255, 410
See application file for complete search history.

(56) References Cited

U.S. PATENT DOCUMENTS

| | | | | |
|---|---|---|---|---|
| 3,871,588 | A | 3/1975 | Long et al. | |
| 4,510,883 | A | 4/1985 | Estes | |
| 4,673,131 | A | 6/1987 | Travis | |
| 4,805,702 | A | 2/1989 | White | |
| 5,269,463 | A * | 12/1993 | Burks | 239/654 |
| 6,135,368 | A | 10/2000 | Protan | |

* cited by examiner

*Primary Examiner* — Steven J Ganey
(74) *Attorney, Agent, or Firm* — Sughrue Mion, PLLC

(57) ABSTRACT

A rock dusting or aggregate distributing apparatus is provided having a cylindrical tank body connected to an air supply unit. A circular member is disposed within the cylindrical tank body between the top member and the bottom member to divide the cylindrical tank body into a top portion and bottom portion, the circular member is configured to inject air from the bottom portion into the top portion in a substantially circumferential direction with respect to an axis of the cylindrical tank body to disperse rock dust or aggregate.

10 Claims, 7 Drawing Sheets

ROCK DUSTING APPARATUS

CROSS-REFERENCE TO RELATED APPLICATIONS

This application claims priority from U.S. Provisional Patent Application No. 61/178,651 filed on May 15, 2009 in the U.S. Patent Trademark Office, the disclosure of which is incorporated herein in its entirety by reference.

BACKGROUND OF THE INVENTION

1. Field of the Invention

Apparatuses and methods consistent with the present invention relate to a rock dusting apparatus for distributing rock dust, aggregate or other materials.

2. Description of the Related Art

The present invention involves an apparatus and method for distributing rock dust particularly for use in the underground coal mining industry. However, the apparatus may be used to distribute other materials.

The accumulation of coal dust common in underground mines can lead to dangerous explosions. To minimize this risk, rock dust is distributed to the face and floor of the mine to reduce the accumulation of coal dust. While mechanical rock dusters are used to apply the rock dust, the machines in existence today require constant attention during operation as well as a large amount of maintenance. Additionally, the known machines are not easily transportable.

Further, some of these machines use highly pressurized air, which may lead unsafe conditions. As such, the tanks containing this highly pressurized air require pressure relief valves to prevent a catastrophic failure of the tank due to the highly pressurized air. These additional mechanical parts add to the cost and maintenance requirements of the machine.

Thus, there exists a need for an improved rock dusting apparatus that solves the maintenance and portability problems.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present invention provides a more efficient way of distributing rock dust particularly for use in underground coal mines. However, this apparatus is not limited to the distribution of rock dust. One of ordinary skill will understand that the present invention may be utilized for the distribution of other types of aggregate and particulate matter.

According to an exemplary aspect of the present invention, there is provided a rock duster including a cylindrical tank body having an inlet portion and an outlet portion, the inlet portion disposed toward a bottom end of the cylindrical tank and the outlet portion disposed toward an top end of the cylindrical tank; an air supply unit connected to the inlet portion of the tank to supply air, wherein the inlet portion injects the air in a substantially circumferential direction with respect to an axis of the cylindrical tank body. The tank body may include a circular top member removably attached to a top of the cylindrical tank body.

The inlet portion may include a circular member disposed at a bottom of the cylindrical tank, the circular member containing a plurality of nozzles directed to inject the air in the substantially circumferential direction. Each of the plurality of nozzles may include an air flow orifice. The plurality of nozzles may be spaced circumferentially from one another, radially spaced from one another, or a combination of both. The circular member may include an agitator attached to the circular member.

According to another exemplary aspect of the invention, the rock dusting apparatus includes a cylindrical tank body having an air inlet and an outlet portion, the air inlet disposed toward a bottom portion of the cylindrical tank and the outlet portion disposed in a top portion of the cylindrical tank; a top member removably attached to a top of the cylindrical tank body and configured to releasably seal the top of the cylindrical tank body; a bottom member attached to a bottom of the cylindrical tank body and configured to seal the bottom of the cylindrical tank body; an air supply unit connected to air inlet to supply air to the bottom portion of the cylindrical tank body; and a circular member disposed within the cylindrical tank body between the top member and the bottom member to divide the cylindrical tank body into the top portion and the bottom portion, the circular member is configured to inject air from the bottom portion into the top portion in a substantially circumferential direction with respect to an axis of the cylindrical tank body.

Each of the plurality of nozzles may include an air flow orifice. The plurality of nozzles may be spaced circumferentially from one another, radially spaced from one another, or a combination of both. The circular member may include an agitator attached to the circular member.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS

Figure 1A:
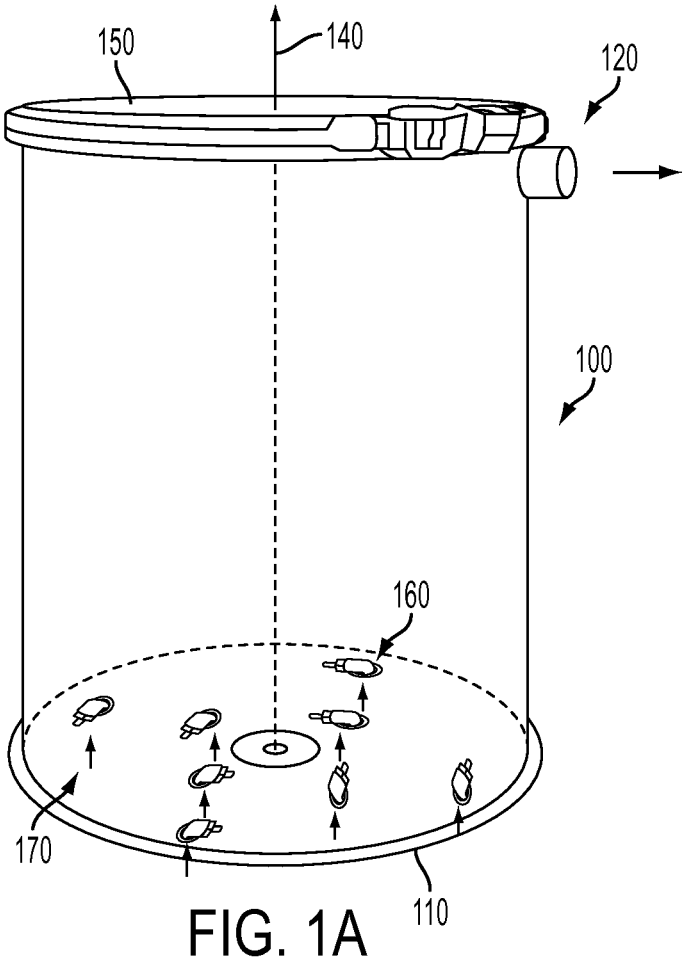
FIG. 1A is a side view of the tank illustrating a rock dusting apparatus according to an exemplary embodiment.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1A shows configuration of a first exemplary embodiment of the present invention. The cylindrical tank body 100 is generally oriented such that its cylindrical axis 140 extends vertically. However, this orientation is not necessary and the cylindrical axis may be arranged toward a horizontal position. However, for the purposes of the description below, assume the cylindrical axis is vertically oriented.

The cylindrical tank body 100 is generally cylindrical in shape and forms a substantially sealed container with the exception of the inlet portion 110 and the outlet portion 120. The top member is 150 removably secured to the cylindrical tank body 100 and removed for the purpose of filling the body with aggregate.

Figure 1B:
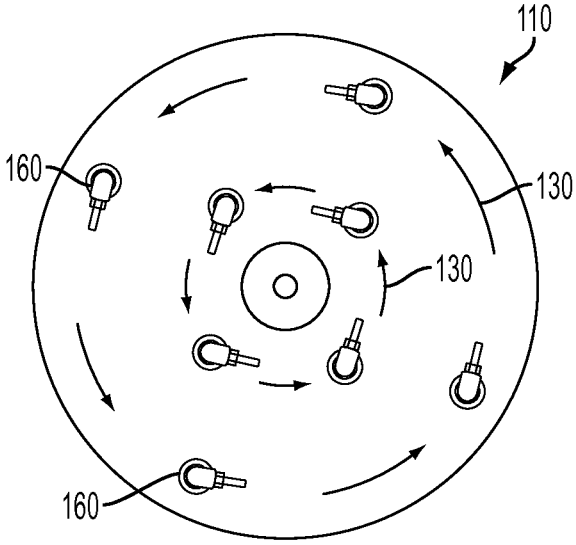
FIG. 1B is a top view of the inlet portion of FIG. 1A.

An air supply source provides pressurized air to the inlet portion 110 disposed at the bottom of the cylindrical tank body 100. The air is distributed into the cylindrical tank body 100 using a plurality of nozzles 160. As shown in FIG. 1B, the nozzles 160 direct the pressurized air 170 into a substantially circumferential air flow 130 with respect to the cylindrical axis 140. This air flow creates a vortex effect within the cylindrical tank body 100 capable mixing some of the aggregate disposed within the cylindrical tank body 100 with the air to carry the aggregate and air mixture to the outlet portion 120. This velocity component of the air (vortex) permits aggregate to be effectively dispersed within the cylindrical tank body 100 without requiring excessive air pressure. The air and aggregate mixture exits the outlet portion 120 to be dispersed where desired.

One aspect of the present embodiment is the use of a regenerative blow 221, which is also known as a ring compressor. While other air sources may be used, the ring compressor provides a relative low pressure, high volume air flow.

The nozzles 160 may be configured as holes within plate metal having a directional component or as holes extending along the cylindrical axis that have directing nozzle portions attached thereto. These directing nozzle portions may be directed to distribute the air in the circumferential direction.

As illustrated in FIG. 1B, the nozzles 160 may be circumferentially spaced from one another around the inlet portion. The nozzles 160 may also be spaced radially from one another. In this embodiment, the nozzles 160 are spaced circumferentially at two different radial positions.

While the shape of the cylindrical tank body 100 is described as cylindrical in this exemplary embodiment, other shapes may be used.

Figure 2:
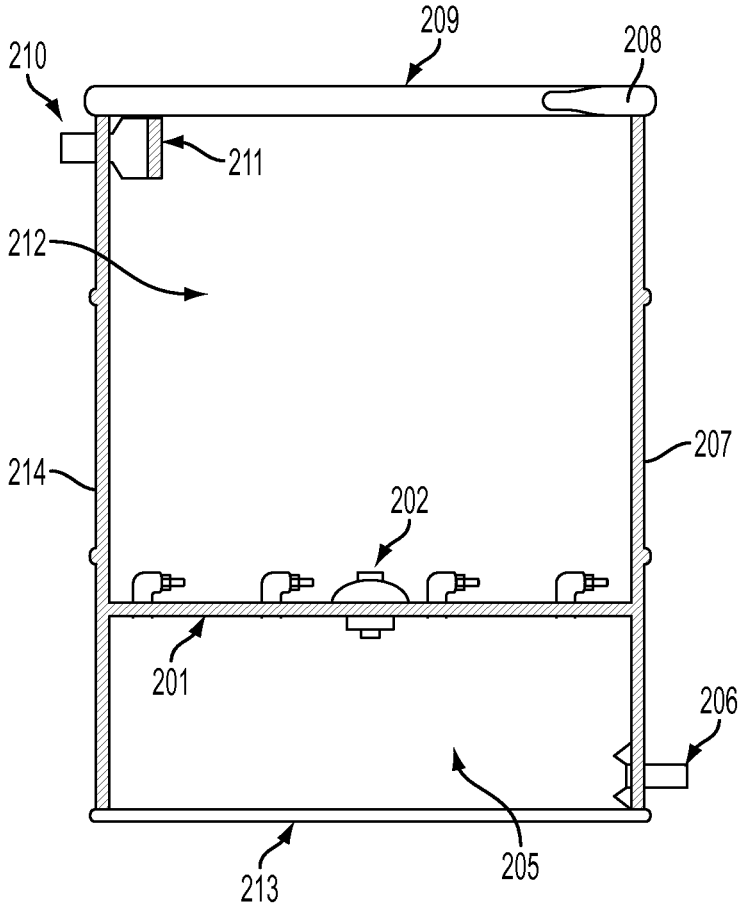
FIG. 2 is a side view of a rock dusting apparatus according to another exemplary embodiment.

FIG. 2 shows a partial sectional view of sealable tank 207 used in the rock duster apparatus. The sealable tank includes a tank lid 2099, a side member 214 and a bottom member 213. The side member 214, the tank lid 209 and the bottom member 213 are connected to each other to form an air-tight seal. To facilitate removal of the tank lid 209, the sealable tank 207 may also include a lid locking lever ring 208 for removably securing and sealing the tank lid 209. The removable tank lid 209 facilitates loading of the sealable tank 207 with rock dust, aggregate, or other particulate matter for distribution.

An air distributor 201 is disposed above the bottom member 213 of dividing the sealable tank 207 into a loading portion 215 and an air expansion chamber 205. The air expansion chamber 205 is positioned below the loading portion 215. The sealable tank 207 also includes an inlet port 206 for supplying pressurized air to the expansion chamber 205. The inlet port 206 may be provided with a control value to control the rate at which the apparatus dispenses the particulate matter. The air from the air expansion chamber 205 is distributed to the loading portion 215, which is loaded with rock dust or other particulate matter to be blow with the air through the outlet 210. The air is distributed using a mass air distributor 201 which distributes the pressurized air so as to induce a vortex in the loading portion 215 of the sealable tank 207. Delivering the air in this manner efficiently uses the energy of the pressurized air to carry the rock dust or other particulate matter to the tank outlet 210 for distribution.

Figure 3A:
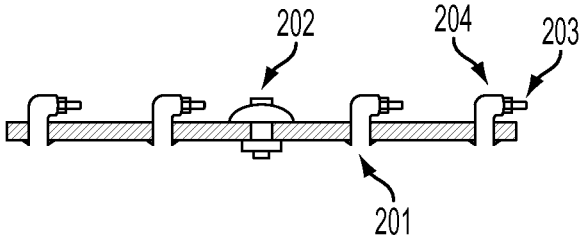
FIG. 3A shows the air distributor of the embodiment of FIG. 2.
Figure 3B:
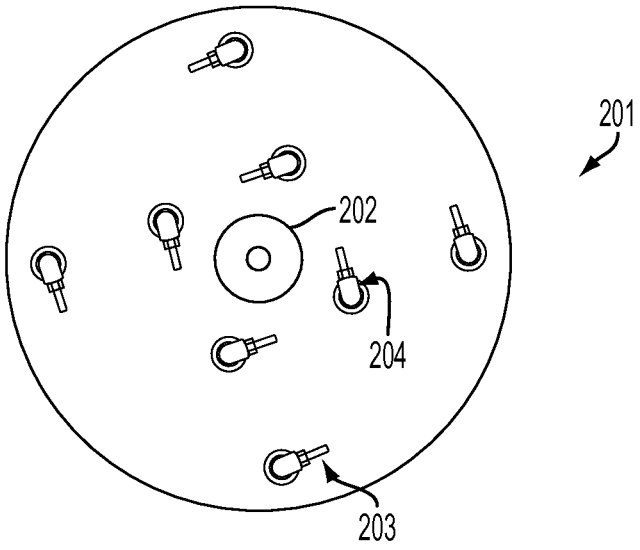
FIG. 3B is a side view air distributor of FIG. 3A.

As shown in FIGS. 2, 3A and 3B, according to this exemplary embodiment, the mass air distributor 201 may include multiple intake ports 204 that distribute air from the air expansion chamber 205 to the upper portion 215 of the tank body 212. The intake ports 204 are provided at various locations on the mass air distributor 201 to induce a vortex air flow in the loading portion 215. The intake portions 204 are disposed in a direction so as to direct the air to induce a circumferential circulation of air in the upper portion 212 of the sealable tank 207. This air flow creates a vortex effect within the upper portion 212 of the sealable tank 207. Accordingly, the air attains a suitable velocity enabling it to carrying the rock dust or other particulate matter toward the tank outlet 210. In this embodiment, the sealable tank 207 is substantially cylindrical to aid in inducing this vortex air circulation. However, other tank shapes may be used.

These intake ports 204 may be directed substantially circumferentially with respect to the center of the tank 207 to aid in directing the air flow to create a vortex. The intake ports 204 may also include air flow orifices 203 to aid in directing the air flow and controlling the amount of air flow. The orifices may be configured to convert the static air pressure of the air in the expansion chamber 205 into air velocity, thereby reducing the static air pressure in the upper portion. Thus, by controlling the velocity of air in this fashion, a vortex of relatively low pressure air may carry the rock dust or particulate to the tank outlet 210.

Also, as shown in FIG. 2, the sealable tank 207 may include an agitator to aid in dislodging the rock dust or other aggregate from the surface of the mass air distributor 201. In the configuration of FIG. 2, this agitator causes vibration as air from the air expansion chamber 205 passes through an air powered agitator 202 attached to the mass air distributor 201.

Operationally, the pressurized air 170 is introduced through the inlet port 206 and enters the air expansion chamber 205. The pressurized air then passes through the mass air distributor 201 through the intake ports 204 and air flow orifices 203, air also passes through the air powered agitator 202, which is used to facilitate the mixing of the air and rock dust.

The air stream which is now in a vortex motion created by the mass air distributor 201, mixes with the dust or aggregate and rises up to the top of tank 207. This rising mixture is then captured by the air directing plate 211, which directs the mixed air and rock dust through the outlet 210 for distribution.

Figure 4:
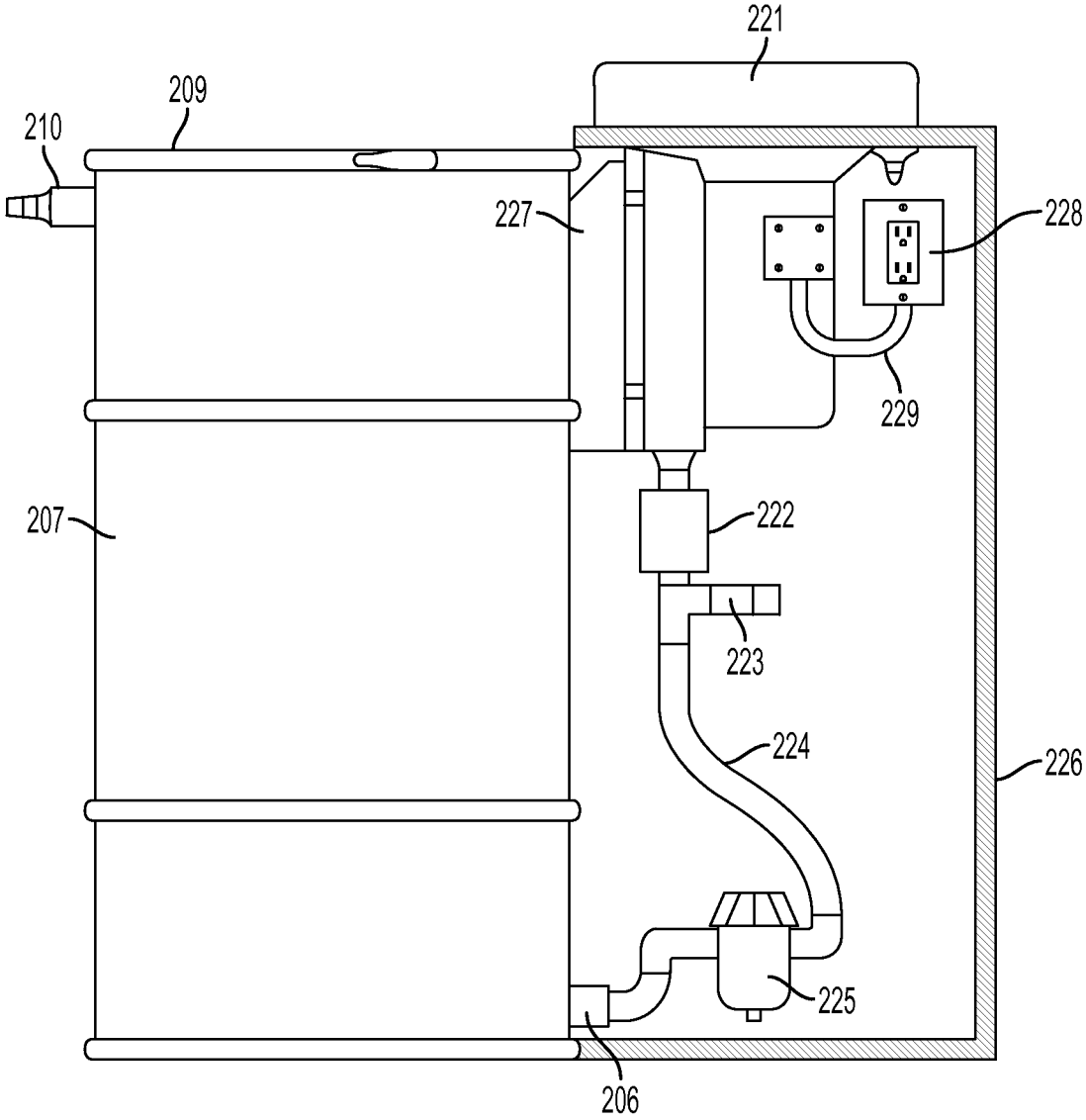
FIG. 4 shows a rock dusting system according to an exemplary embodiment.

FIGS. 4 and 5 show a rock dusting system according to another exemplary embodiment of the present invention. This air supply system is shown in combination with the exemplary embodiment of FIG. 2, but can also be applied to the exemplary embodiment of FIG. 1.

The regenerative blower and tank assembly of FIG. 4 shows regenerative blower 221 coupled to a sealable tank 207 using an inlet port 206. The air supply system includes an inlet filter 222 disposed on the inlet port 216 of the regenerative blower 221. An outlet relief value 223 is disposed on the outlet port 217 of regenerative blower 221 to prevent excessive back pressure from damaging the regenerative blower 221. A hose 224 transfers the pressurized air from the regenerative blower 221 to an air moisture separator 225. The air moisture separator 225 is not required but may aid in the distribution of aggregate or other particulate matter whose physical properties are negatively impacted by moisture. As illustrated in FIG. 4, the pressurized air leaving the moisture separator 225 enters the inlet port 206 of the sealable tank 207. If used in the exemplary embodiment of FIG. 1, a distribution manifold may be utilized to distribute the air to each nozzle.

The system includes a motor starter 228 connected to the regenerative blower 221 by an electric cable 229.

Figure 5A:
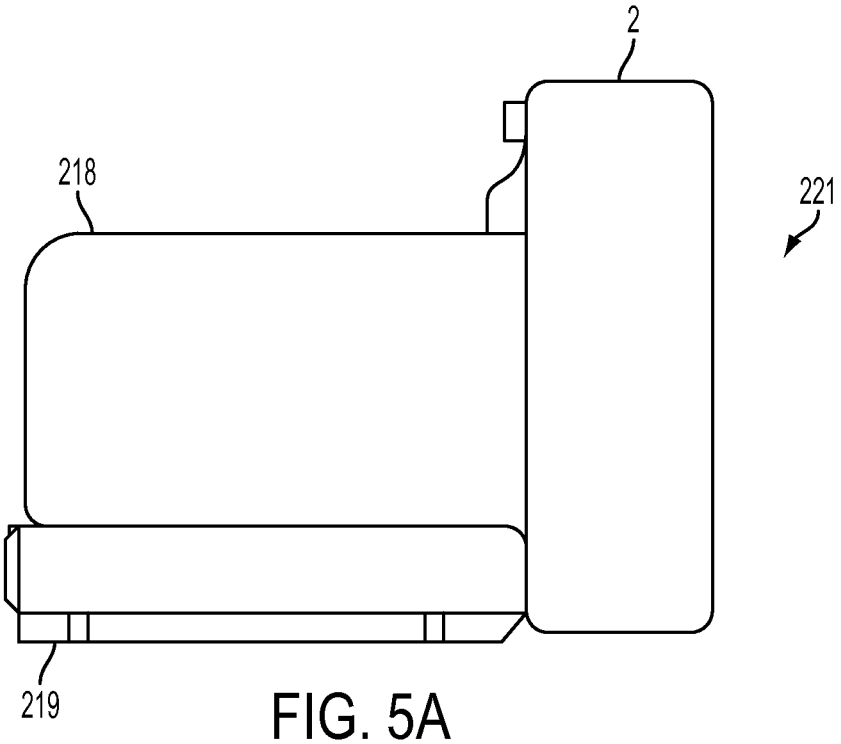
FIGS. 5A and 5B show the regenerative blower of FIG. 4.
Figure 5B:
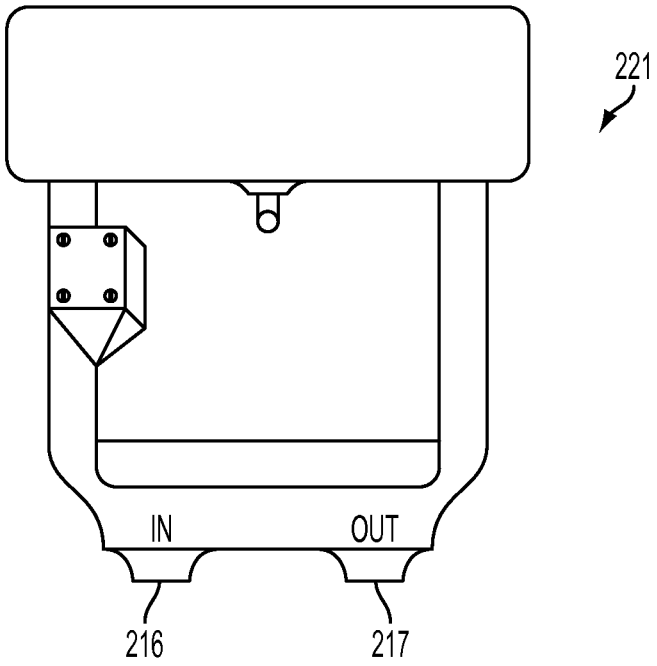

As shown in FIGS. 5A and 5B, the regenerative blower FIG. 3 may include an electric motor 218, an enclosed fan assembly 2, a mounting plate 219, and inlet port 216 and an outlet port 217. The regenerative blower 221 pulls air into the inlet port 216 and pushes air through the outlet port 217 at a predetermined volume or CFM to supply the rock duster apparatus.

In operation, the lid locking lever 208 and lid 209 are removed. Rock dust or other aggregate is placed into tank 207. The lid 209 is replaced and locking lever ring 208 is engaged. The motor starter 228 is electrically connected, such as by using an electric extension cord. The motor starter 228 is engaged and the rock dust is distributed.

Figure 6:
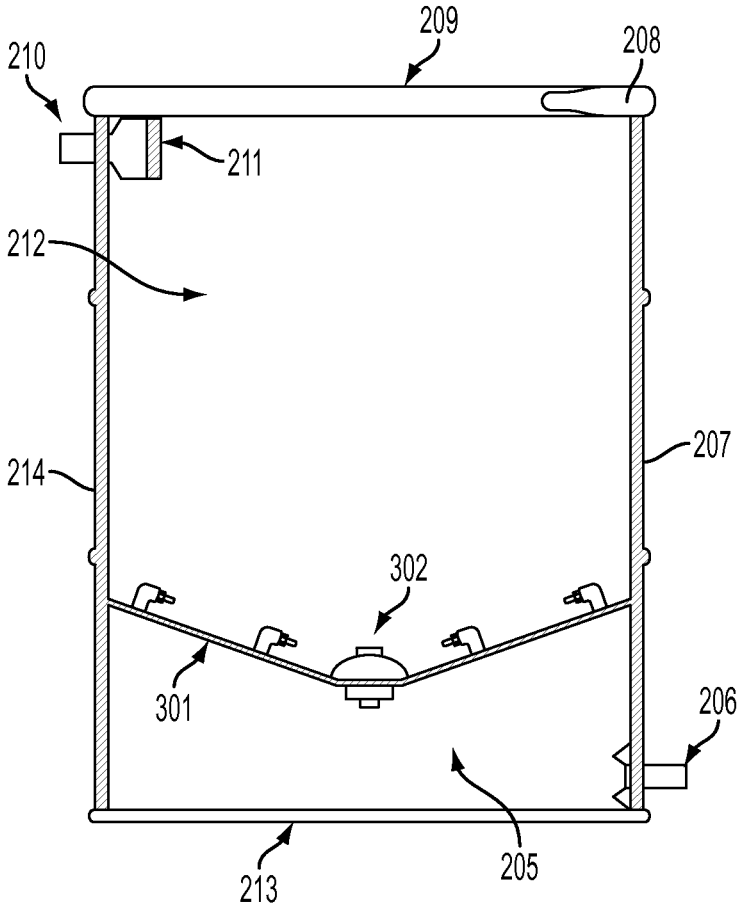
FIG. 6 shows a side view of a rock dusting apparatus according to another exemplary embodiment.
Figure 7:
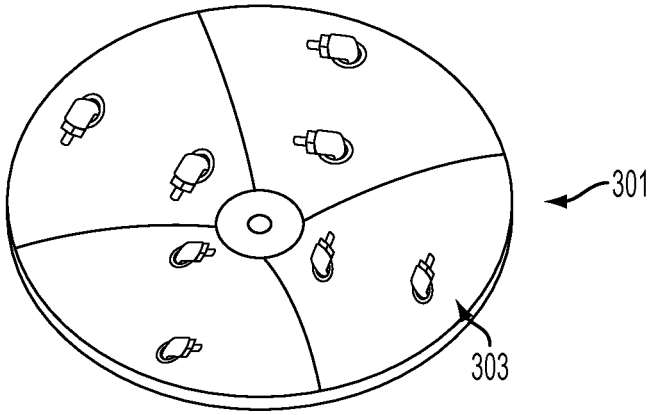
FIG. 7 shows a perspective view of an air distributor of the embodiment of FIG. 6.
Figure 8:
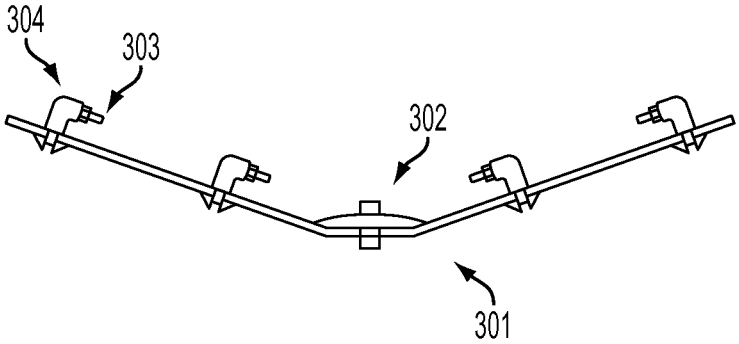
FIG. 8 shows a side view of an air distributor of the embodiment of FIG. 6.

In another embodiment shown in FIGS. 6-8, the shape of the mass air distributor 301 may be modified into a concave shape. This mass air distributor 301 may be used in combination with the other features of tank 207 discussed in FIGS. 1-5. This concave shape improves the ability of the apparatus to induce vortex/tornado effect within the sealable tank 207 and aids in eliminating dead zones where material is not blown from the tank during normal operation. As shown in the figures, the air flow orifices 303 are disposed on intake ports 304 positioned at multiple locations along the surface of the mass air distributor 301 to distribute air from the air expansion chamber 205 to the upper portion 212 of the sealable tank 207. An air powered agitator 302 may also be disposed in the center of the mass air distributor 301.

Testing has shown that the apparatus effectively emits rock dust when using approximately 0.625 cfm per 1 pound of dust per hour when the air pressure is less than 5 psi. However, in the embodiments shown above, the air pressure supplied to the tank may range from 3 to 8 psi. For example, to distribute 250 lbs of rock dust over an 8 hour period, a 2 hp ring air compressor at 150 cfm may be used.

However, air flow requirements will change with the particulate or aggregate to be dispersed using the apparatus described above. The apparatus is not limited to rock dust distribution and may be used to distribute seed, fertilizer or any other particular requiring dispersion.

Although a few exemplary embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A rock dusting apparatus comprising:

a cylindrical tank body having an air inlet and an outlet portion, the air inlet disposed toward a bottom portion of the cylindrical tank and the outlet portion disposed in a top portion of the cylindrical tank;

a top member removably attached to a top of the cylindrical tank body and configured to releasably seal the top of the cylindrical tank body;

a bottom member attached to a bottom of the cylindrical tank body and configured to seal the bottom of the cylindrical tank body;

an air supply unit connected to air inlet to supply air to the bottom portion of the cylindrical tank body; and a circular member disposed within the cylindrical tank body between the top member and the bottom member to divide the cylindrical tank body into the top portion and the bottom portion, the circular member is configured to inject air from the bottom portion into the top portion in a substantially circumferential direction with respect to an axis of the cylindrical tank body.

2. The rock dusting apparatus according to claim 1, wherein the circular member includes a plurality of nozzles directed to inject the air in the substantially circumferential direction.

3. The rock dusting apparatus according to claim 2, wherein each of the plurality of nozzles includes an air flow orifice.

4. The rock dusting apparatus according to claim 2, wherein the plurality of nozzles are spaced circumferentially from one another.

5. The rock dusting apparatus according to claim 2, wherein the plurality of nozzles are spaced radially from one another.

6. The rock dusting apparatus according to claim 1, wherein the air supply unit is a regenerative blower.

7. The rock dusting apparatus according to claim 1, further comprising a circular top member removably attached to a top of the cylindrical tank body.

8. The rock dusting apparatus according to claim 1, further comprising an agitator attached to the circular member.

9. The rock dusting apparatus according to claim 8, wherein the agitator is air powered.

10. The rock dusting apparatus according to claim 1, wherein the circular member has a concave shape having a central section disposed lower than an outer peripheral section.

* * * * *